US009746176B2

(12) United States Patent
Doura et al.

(10) Patent No.: US 9,746,176 B2
(45) Date of Patent: Aug. 29, 2017

(54) MODULATING BURNER WITH VENTURI DAMPER

(71) Applicant: Lochinvar, LLC, Lebanon, TN (US)

(72) Inventors: Mohamed Mehdi Doura, Mt. Juliet, TN (US); Benjamin P. Putnam, Watertown, TN (US); Dave C. Baese, Brentwood, TN (US); Robert Wesley Wiseman, Brentwood, TN (US)

(73) Assignee: Lochinvar, LLC, Lebanon, TN (US)

( * ) Notice: Subject to any disclaimer, the term of this patent is extended or adjusted under 35 U.S.C. 154(b) by 280 days.

(21) Appl. No.: 14/295,409

(22) Filed: Jun. 4, 2014

(65) Prior Publication Data

US 2015/0354809 A1 Dec. 10, 2015

(51) Int. Cl.

| | |
|---|---|
| ***F23D 14/04*** | (2006.01) |
| ***F23C 9/00*** | (2006.01) |
| ***F24H 1/00*** | (2006.01) |
| ***F23L 13/04*** | (2006.01) |
| ***F23N 1/02*** | (2006.01) |

(Continued)

(52) U.S. Cl.

CPC ..... *F23D 14/04* (2013.01); *F23C 3/004* (2013.01); *F23C 9/00* (2013.01); *F23D 14/60* (2013.01); *F23L 13/04* (2013.01); *F23N 1/025* (2013.01); *F24H 1/0027* (2013.01); *F23D 2208/00* (2013.01); *F23D 2900/00014* (2013.01); *F23D 2900/21003* (2013.01); *F23N 2027/22* (2013.01); *F23N 2033/04* (2013.01); *F23N 2035/10* (2013.01); *F23N 2035/18* (2013.01); *F23N 2037/10* (2013.01)

(58) Field of Classification Search

CPC ..... F23D 14/02; F23D 14/04; F23Q 9/00

See application file for complete search history.

(56) References Cited

U.S. PATENT DOCUMENTS

| | | | |
|---|---|---|---|
| 2,361,150 | A | 10/1944 | Petroe |
| 2,447,263 | A | 8/1948 | Mock |
| 2,763,983 | A | 9/1956 | Kafka |

(Continued)

FOREIGN PATENT DOCUMENTS

| | | | |
|---|---|---|---|
| DE | 29617621 | U1 | 8/1997 |
| DE | 19756301 | A1 | 6/1998 |

(Continued)

OTHER PUBLICATIONS

DE19756301A1—machine translation.*

(Continued)

*Primary Examiner* — Nathaniel Herzfeld

(74) *Attorney, Agent, or Firm* — Lucian Wayne Beavers; Patterson Intellectual Property Law, PC

(57) ABSTRACT

A modulating burner apparatus includes a burner and a blower placed upstream of the burner. A venturi is placed upstream of the blower. A damper valve is placed upstream of the venturi. The damper valve has an open position and a restricted position. A smaller gas valve and a larger gas valve are communicated with the venturi. A controller is operably associated with the system to select a position of the damper valve and to select the appropriate one of the gas valves so as to provide a low output operation mode and a high output operation mode, which in combination provide an overall turndown ratio of at least 25:1.

14 Claims, 7 Drawing Sheets

(51) Int. Cl.
*F23C 3/00* (2006.01)
*F23D 14/60* (2006.01)

(56) References Cited

U.S. PATENT DOCUMENTS 2,778,191 A 1/1957 Thompson
2,857,961 A 10/1958 Brown, III et al.
2,953,160 A 9/1960 Brazier
3,167,251 A * 1/1965 Kriechbaum ..... G05D 23/2754 236/1 E
3,220,805 A 11/1965 Fowler et al.
3,237,399 A * 3/1966 Sheffer ..... F01N 3/22 137/520
3,397,940 A 8/1968 Keppel
3,442,489 A 5/1969 Cary et al.
3,469,567 A * 9/1969 Bergquist ..... F24C 3/128 126/39 E
3,577,964 A 5/1971 Lazar
3,692,016 A 9/1972 Stikkers et al.
3,700,376 A 10/1972 Niepenberg et al.
3,723,050 A 3/1973 Stevens, Jr. et al.
3,762,639 A 10/1973 Katchka et al.
3,825,398 A 7/1974 Katchka et al.
3,840,330 A 10/1974 Katchka
3,844,704 A 10/1974 Helke
3,846,064 A 11/1974 Katchka
3,870,458 A 3/1975 Hendrick
4,257,762 A 3/1981 Zink et al.
4,425,930 A * 1/1984 Kruto ..... F23N 1/002 137/1
4,723,513 A 2/1988 Vallett et al.
4,793,800 A 12/1988 Vallett et al.
4,834,644 A * 5/1989 Snow ..... F23N 1/022 431/1
5,399,085 A 3/1995 Taylor
5,611,684 A * 3/1997 Spielman ..... F23D 14/34 239/431
5,860,451 A 1/1999 Raleigh et al.
5,971,026 A * 10/1999 Beran ..... F23D 14/64 137/888
6,604,938 B1 * 8/2003 Blaauwwiekel ..... F23D 14/04 137/513.7
6,694,926 B2 * 2/2004 Baese ..... F23D 14/02 122/14.2
6,990,964 B2 1/2006 Ströhle
7,028,642 B2 4/2006 Peart
7,261,061 B2 8/2007 Shellenberger et al.
7,448,204 B2 11/2008 Nishimura et al.
7,494,079 B1 2/2009 Siracusa
7,770,559 B2 8/2010 Cobb, Jr.
7,878,797 B1 2/2011 Swanson et al.
8,113,823 B2 2/2012 Guzorek
8,172,568 B2 5/2012 Kashihara et al.
8,286,594 B2 10/2012 Smelcer
8,512,035 B2 * 8/2013 Super ..... F23D 14/64 431/177
8,668,491 B2 * 3/2014 Praat ..... F23N 5/184 236/15 BD
2005/0175944 A1 * 8/2005 Ahmady ..... F23C 3/002 431/18
2007/0068146 A1 3/2007 Rolffs et al.
2008/0216771 A1 * 9/2008 Paine ..... F23N 1/082 122/14.2
2010/0043727 A1 * 2/2010 Clark ..... F23N 3/042 122/18.1
2010/0095905 A1 4/2010 Smelcer
2010/0116225 A1 * 5/2010 Smelcer ..... F23D 14/02 122/17.1
2010/0313827 A1 12/2010 Moore
2011/0104621 A1 5/2011 Binzer
2011/0139045 A1 * 6/2011 Zatti ..... F23D 14/60 110/188
2013/0139802 A1 6/2013 Noman et al.
2015/0064636 A1 3/2015 Yu
2015/0354810 A1 12/2015 Nakatani et al.
2016/0161112 A1 6/2016 Zatti et al.
2016/0161114 A1 6/2016 Ranalli et al.

FOREIGN PATENT DOCUMENTS

DE 102013220954 A1 4/2015
EP 0682210 B1 10/1997
EP 0890787 A2 1/1999
EP 0907051 A1 4/1999
EP 1030108 A1 8/2000
EP 1482245 A1 12/2004
EP 2372247 A2 10/2011
EP 2664849 A2 11/2013
EP 2597370 B1 8/2014
EP 2863120 A1 4/2015
EP 2863125 A1 4/2015
EP 2597369 B1 7/2015
JP 09210349 A 8/1997
KR 20130098818 A 9/2013
WO 02077526 A1 10/2002

OTHER PUBLICATIONS

JPH09210349A—machine translation.*
International Search Report and Written Opinion in corresponding International Application No. PCT/US2015/029089, dated Jul. 24, 2015, 12 pp. (not prior art).

* cited by examiner

MODULATING BURNER WITH VENTURI DAMPER

BACKGROUND OF THE INVENTION

1. Field of the Invention

The present invention relates generally to a modulating burner apparatus, and more specifically, but not by way of limitation, to a gas fired appliance incorporating a modulating burner.

2. Description of the Prior Art

Most conventional gas fired burner technologies utilize a single chamber burner designed to operate at a fixed flow rate of combustion air and fuel gas to the burner. Such technologies require that the burner cycles off in response to a control system which determines when the demand for energy has been met, and cycles back on at a predetermined setpoint when there is a demand for more energy. One example of such a typical prior art system which is presently being marketed by the assignee of the present invention is that shown in U.S. Pat. Nos. 4,723,513 and 4,793,800 to Vallett et al., the details of which are incorporated herein by reference.

The assignee of the present invention has also developed a continuously variable modulating burner apparatus for a water heating appliance with variable air and fuel input, as shown in U.S. Pat. No. 6,694,926 to Baese et al. In the Baese apparatus combustion air and fuel are introduced separately in controlled amounts upstream of a blower and are then premixed and delivered into a single chamber burner at a controlled blower flow rate within a prescribed blower flow rate range. This allows the heat input of the water heating appliance to be continuously varied within a substantial flow range having a burner turndown ratio of as much as 4:1. It should be understood by those skilled in the art that a 4:1 burner turndown capability will result in the appliance remaining in operation for longer periods of time during a typical seasonal demand than an appliance with less than 4:1 burner turndown ratio, or with appliances with no turndown ratio at all.

More recently, the assignee of the present invention has developed a water heating appliance including a dual-chamber burner, with dual blower assemblies providing fuel and air mixture to the chambers of the burner, as shown in U.S. Pat. No. 8,286,594 to Smelcer, the details of which are incorporated herein by reference. Through the use of the dual blower assemblies this system is capable of achieving turndown ratios of as much as 25:1 or greater. It should be understood by those skilled in the art that a 25:1 burner turndown capability will result in the appliance remaining in operation for longer periods of time during a typical seasonal demand than an appliance with less than 25:1 burner turndown ratio, or with appliances with no burner turndown ratio at all.

There is a continuing need for improvements in modulating burners which can provide modulation of heat input over a wider range of heat demands. Particularly there is a need for systems providing high turndown ratios with reduced mechanical complexity at significantly reduced cost as compared to known practices today.

SUMMARY OF THE INVENTION

In one embodiment a burner assembly includes a burner, and a blower configured to supply pre-mixed air and fuel gas mixture to the burner. The blower includes a blower inlet. A venturi includes a venturi inlet, a venturi outlet, and a reduced pressure zone intermediate of the venturi inlet and the venturi outlet. The blower inlet is communicated with the venturi outlet such that the blower pulls air through the venturi. At least one gas valve is communicated with the reduced pressure zone such that the at least one gas valve supplies fuel gas to the reduced pressure zone at a fuel gas flow rate corresponding to a pressure in the reduced pressure zone. An air flow restrictor is located upstream of the reduced pressure zone and is movable between an open position and a restricted position, such that in the restricted position air flow through the venturi is restricted.

In another embodiment a burner assembly includes a burner, a blower upstream of the burner, a venturi upstream of the blower, and a damper valve upstream of the venturi. The damper valve has an open position and a restricted position. A smaller gas valve and a larger gas valve are each communicated with the venturi. A controller is operably associated with the blower, the damper valve, and the smaller and larger gas valves.

In another embodiment a method is provided of operating a pre-mix burner, the method comprising:

(a) modulating the burner within a low output range by modulating a speed of a variable speed blower while drawing air to a venturi through a damper valve in a restricted position, and while drawing fuel gas to the venturi through a smaller gas valve; and (b) modulating the burner within a high output range by modulating the speed of the variable speed blower while drawing air to the venturi through the damper valve in an open position, and while drawing fuel gas to the venturi through a larger gas valve.

In any of the above embodiments the air flow restrictor may be a damper comprising a disc-shaped valve element. The restrictor defines an annular flow path around the disc-shaped valve element when the air flow restrictor is in the restricted position.

In any of the above embodiments the annular flow path may have an annular thickness in a range of from about 0.010 inch to about 0.150 inch, and more preferably in a range from about 0.050 inch to about 0.120 inch.

In any of the above embodiments the at least one gas valve may include a larger gas valve and a smaller gas valve, both gas valves being communicated with the reduced pressure zone of the venturi.

In any of the above embodiments the smaller gas valve may include a reference pressure line communicated upstream of the air flow restrictor.

In any of the above embodiments the assembly may further include a controller operably associated with the flow restrictor, the larger gas valve and the smaller gas valve. The controller may be configured to operate the larger gas valve when the flow restrictor is in the open position, and the controller may be configured to operate the smaller gas valve when the flow restrictor is in the restricted position.

In any of the above embodiments the blower may be a variable speed blower having a blower speed variable within a blower speed range, and the controller may be operably associated with the blower and configured such that the burner is modulatable within a higher burner output range by varying the blower speed within the blower speed range when the larger gas valve is operable and the flow restrictor is in the open position, and the controller may be configured such that the burner is modulatable within a lower burner output range by varying the blower speed within the blower speed range when the smaller gas valve is operable and the flow restrictor is in the restricted position.

In any of the above embodiments the higher burner output range may overlap the lower burner output range, preferably by at least 50,000 BTU/hr.

In any of the above embodiments the burner assembly may have a turndown ratio from a high end of the higher burner output range to a low end of the lower burner output range of at least about 25:1.

In any of the above embodiments the burner higher output range may have a high end of at least 750,000 BTU/hr.

In any of the above embodiments the venturi may include a venturi body having a venturi passage from the venturi inlet to the venturi outlet, and the flow restrictor may be located within the venturi passage.

In any of the above embodiments the venturi may include a reduced diameter throat, and the reduced pressure zone may be an annular zone surrounding and communicated with the reduced diameter throat.

In any of the above embodiments the burner assembly may be used in combination with a water heater, with the water heater being in heat exchange relationship with the burner.

Any of the above embodiments may further include a pilot located adjacent the burner such that a pilot flame from the pilot can ignite the burner. A pilot valve communicates a gas source with the pilot. The controller is configured to open the pilot valve so as to initiate the pilot flame prior to transitioning between operation of the smaller gas valve and operation of the larger gas valve.

In any of the above embodiments the controller may be configured to close the pilot valve after transitioning between the operation of the smaller gas valve and operation of the larger gas valve.

In any of the above embodiments the controller may define a low range operation mode of the burner assembly and a high range operation mode of the burner assembly.

In any of the above embodiments, in the low range operation mode the damper valve is in the restricted position, and the smaller gas valve is operably communicated with the venturi, and the blower is modulated to provide fuel and air mixture to the burner within a low output range.

In any of the above embodiments in the high range operation mode, the damper valve is in the open position, the larger gas valve is operably communicated with the venturi, and the blower is modulated to provide fuel and air mixture to the burner within a high output range, the high output range extending higher than the low output range and overlapping with the low output range.

In any of the above embodiments the disc-shaped valve may have a diameter in a range of from about 3.0 inches to about 6.0 inches.

In any of the above embodiments the damper valve may include a damper valve body having a circular cross-section passage therethrough and having a passage diameter. A valve shaft extends diametrically across the passage. A valve disc is attached to the valve shaft and has a diameter less than the passage diameter. A valve motor is attached to the valve shaft and constructed to rotate the valve shaft approximately 90° between the open position and the restricted position.

In any of the above embodiments the valve motor may always rotate in the same direction as it moves the damper valve between its open and restricted positions.

In any of the above embodiments the damper valve may include a spring disposed around the valve shaft and biasing the valve shaft relative to the damper valve body so as to eliminate slack in the diametrical positioning of the valve disc within the circular cross section passage.

In any of the above embodiments, when the damper valve is in its restricted position air flows to the venturi through an annular passage of the damper valve adjacent an inner wall of the venturi so that the air flows primarily in a boundary layer adjacent the inner wall.

Other and further objects, features and advantages of the present invention will be readily apparent to those skilled in the art upon a reading of the following disclosure when taken in conjunction with the accompanying drawings.

DETAILED DESCRIPTION OF THE INVENTION

Figure 1:
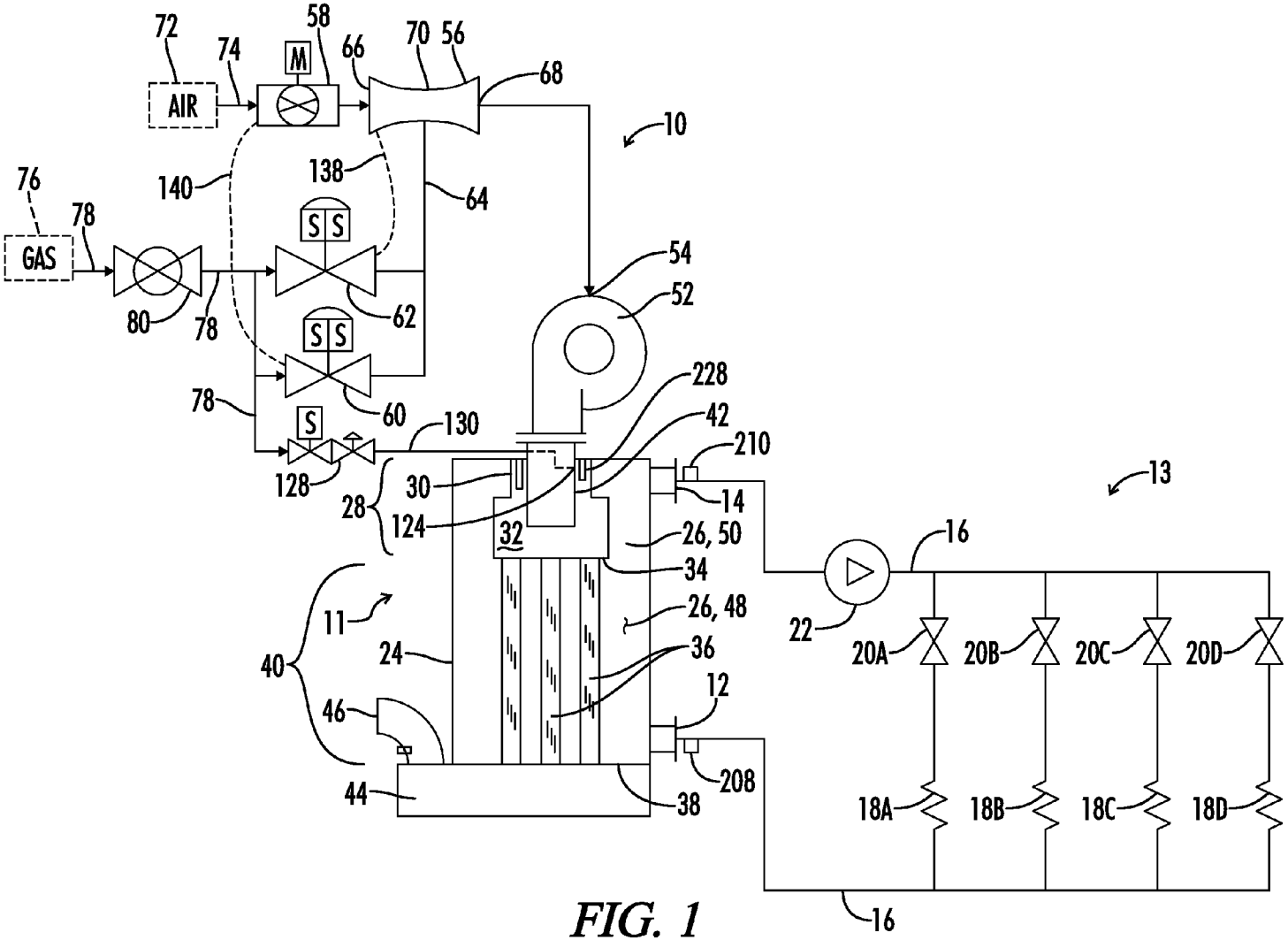
FIG. 1 is a schematic illustration of a modulating burner assembly having a burner fed by a single variable speed blower with a venturi and damper assembly upstream of the blower. The burner assembly is shown as used in a water heating appliance.

Referring now to the drawings, and particularly to FIG. 1, a burner assembly is shown and generally designated by the numeral 10. The burner assembly 10 is shown as used in a water heating apparatus or appliance 11 as part of a system 13 for heating water, but it will be understood that in its broadest application the burner assembly 10 may be used in any system in which it is desired to provide a modulating burner having a high turndown ratio. For example, the burner assembly 10 may be used as a burner for an industrial furnace or the like.

As used herein, the terms water heating apparatus or water heating appliance or water heating system or water heater apparatus or water heater all are used interchangeably and all refer to an apparatus for heating water, including both boilers and water heaters as those terms are commonly used in the industry. Such apparatus are used in a wide variety of commercial and residential applications including potable water systems, space heating systems, pool heaters, process water heaters, and the like. Also, the water being heated can include various additives such as antifreeze or the like.

The water heating apparatus 11 illustrated in FIG. 1 is a fire tube heater. A fire tube heater is one in which the hot combustion gases from the burner flow through the interior of a plurality of tubes. Water which is to be heated flows around the exterior of the tubes. The operating principles of the burner assembly 10 are equally applicable, however, to use in water heaters having the water flowing through the interior of the tubes and having the hot combustion gases on the exterior of the tubes, such as for example the design shown in U.S. Pat. No. 6,694,926 to Baese et al. discussed above.

The water heating apparatus 11 shown in the system 13 of FIG. 1 is connected to a heat demand load in a manner sometimes referred to as full flow heating wherein a water inlet 12 and water outlet 14 of the heating apparatus 11 are directly connected to a flow loop 16 which carries the heated water to a plurality of loads 18A, 18B, 18C and 18D. The loads 18A-18D may, for example, represent the various heating loads of heat radiators contained in different areas of a building. Heat to a given area of the building may be turned on or off by controlling zone valves 20A-20D. Thus as a radiator is turned on and off or as the desired heat is regulated in various zones of the building, the water flow permitted to that zone by zone valve 20 will vary, thus providing a varying water flow through the flow loop 16 and a varying heat load on the water heating apparatus 11 and its burner assembly 10. A supply pump 22 in the flow loop 16 circulates the water through the system 13. The operating principles of the water heating apparatus 11 and its burner assembly 10 are, however, also applicable to heating apparatus connected to other types of water supply systems, such as for example a system using a primary flow loop for the heat loads, with the water heating apparatus being in a secondary flow loop so that not all of the water circulating through the system necessarily flows back through the water heater. An example of such a primary and secondary flow loop system is seen in U.S. Pat. No. 7,506,617 of Paine et al., entitled "Control System for Modulating Water Heater", and assigned to the assignee of the present invention, the details of which are incorporated herein by reference.

The water heating apparatus 11 includes an outer jacket 24. The water inlet 12 and water outlet 14 communicate through the jacket 24 with a water chamber 26 or water side 26 of the heat exchanger. In an upper or primary heat exchanger portion 28, an inner heat exchange wall or inner jacket 30 has a combustion chamber or combustion zone 32 defined therein. The lower end of the combustion chamber 32 is closed by an upper tube sheet 34. A plurality of fire tubes 36 have their upper ends connected to upper tube sheet 34 and their lower ends connected to a lower tube sheet 38. The fire tubes extend through a secondary heat exchanger portion 40 of the water heating apparatus 11.

A burner 42 is located within the combustion chamber 32. The burner 42 burns pre-mixed fuel and air within the combustion chamber 32. The hot gases from the combustion chamber 32 flow down through the fire tubes 36 to an exhaust collector 44 and out an exhaust flue 46.

Water from flow loop 16 to be heated flows in the water inlet 12, then around the exterior of the fire tubes 36 and up through a secondary heat exchanger portion 48 of water side 26, and continues up through a primary heat exchanger portion 50 of water side 26, and then out through water outlet 14. It will be appreciated that the interior of the water heating apparatus 11 includes various baffles for directing the water flow in such a manner that it generally uniformly flows around all of the fire tubes 36 and through the water chamber 50 of primary heat exchanger 28 between the outer jacket 24 and inner jacket 30. As the water flows upward around the fire tubes 36 of the secondary heat exchanger 40 the water is heated by heat transfer from the hot combustion gases inside of the fire tubes 36 through the walls of the fire tubes 36 into the water flowing around the fire tubes 36. As the heated water continues to flow upward through the water side 50 of primary heat exchanger 28 additional heat is transferred from the combustion chamber 32 through the inner jacket 30 into the water contained in water side 50.

Figure 10:
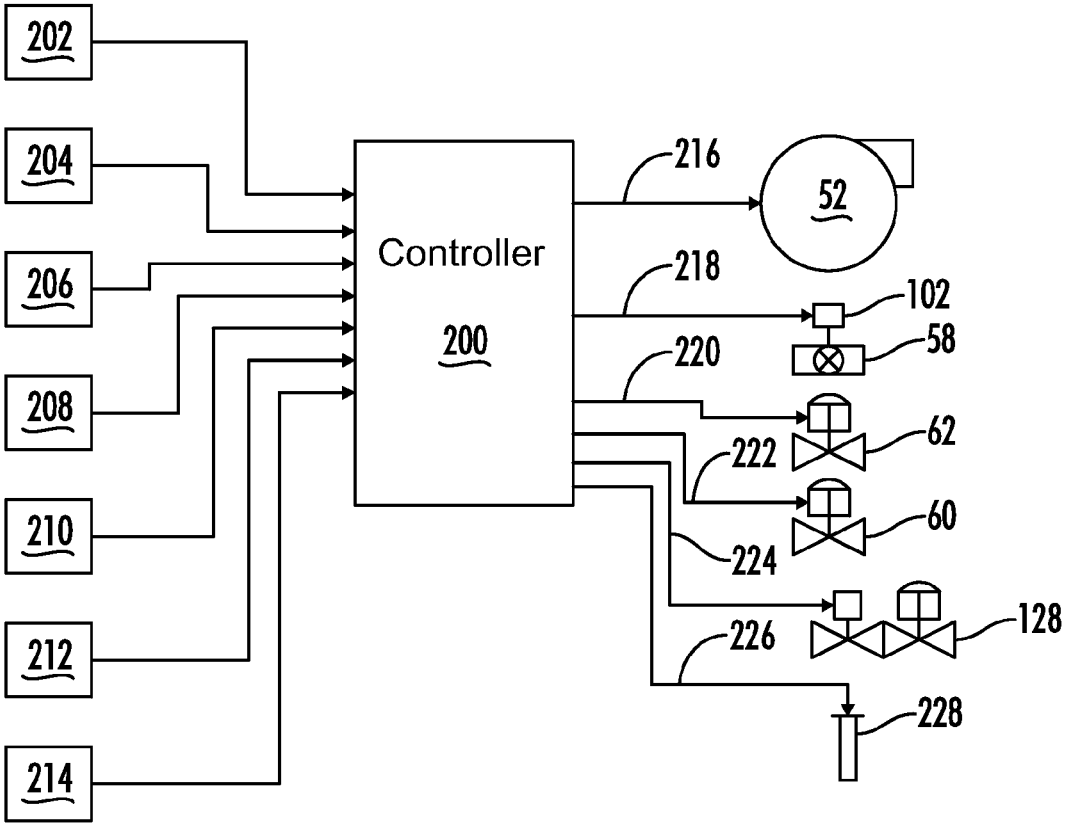
FIG. 10 is a schematic representation of an electronic control system for the water heating system of FIG. 1.

FIG. 10 schematically illustrates a control system that may be included in the water heating apparatus 11. The control system includes a controller 200. The controller 200 receives various inputs from sensors 202-214. Sensor 202 may be a pilot flame sensor associated with the pilot 124. Sensor 204 may be a main burner flame sensor associated with the burner 42. Sensor 206 may be a blower speed sensor. Sensor 208 may be an inlet water temperature sensor. Sensor 210 may be an outlet water temperature sensor. Sensor 212 may be a room temperature sensor. Input 214 may be a set point input, for example from a room temperature thermostat, or for a thermostat of a water supply storage tank associated with the water heater 11.

The controller 200 also provides output signals to various components, such as a blower speed control signal over line 216 to blower 52, a damper motor control signal over line 218 to valve motor 102 of damper 58, a control signal over line 220 to large gas valve 62, a control signal over line 222 to small gas valve 60, a control signal over line 224 to pilot valve 128, and an ignition signal over line 226 to a direct spark ignition element 228 adjacent the burner 42.

The Burner Assembly

Figure 2:
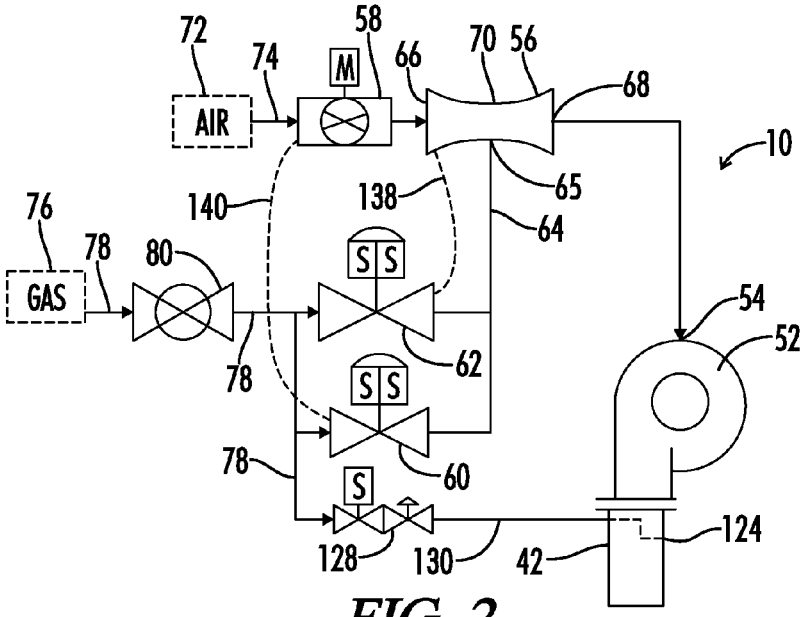
FIG. 2 is a schematic illustration of the burner assembly of FIG. 1.
Figure 3:
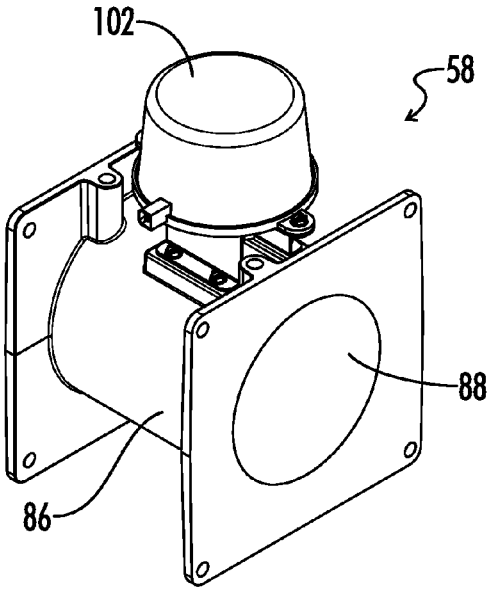
FIG. 3 is perspective view of the motorized damper used in the burner assembly of FIG. 2.
Figure 4:
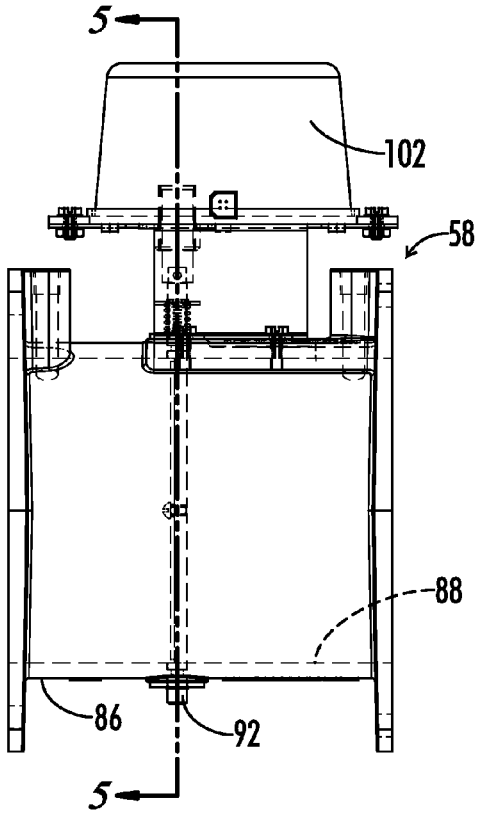
FIG. 4 is a side elevation view of the motorized damper of FIG. 3.

As schematically illustrated in FIG. 2, the burner assembly 10 includes the burner 42 and a blower 52 configured to supply pre-mixed air and fuel gas mixture to the burner 42. The blower 52 includes a blower inlet 54.

The burner assembly 10 further includes a venturi 56 upstream of the blower 52, and a damper valve or air flow restrictor 58 upstream of the venturi 56.

The burner assembly 10 further includes a smaller gas valve 60 and a larger gas valve 62 each of which are communicated with an inlet 65 of the venturi 56 via gas supply line 64.

The venturi 56 includes a venturi inlet 66, a venturi outlet 68, and a reduced pressure zone 70 intermediate of the inlet and the outlet. The details of the venturi 56 are best seen in the enlarged cross-sectional view of FIG. 8.

The blower inlet 54 is communicated with the venturi outlet 68 such that the blower 52 pulls air through the venturi 56.

Air is provided from an air source 72 via air inlet line 74 to the inlet of the damper valve 58. Fuel gas is provided from a gas source 76 via gas inlet line 78 to the gas valves 60 and 62. A shutoff valve 80 is disposed in the gas inlet line 78. Shutoff valve 80 may be a manual ball valve.

The gas valves 60 and 62 are each communicated with the reduced pressure zone 70 of venturi 56 such that they supply fuel gas to the reduced pressure zone 70 at a fuel gas flow rate corresponding to a pressure in the reduced pressure zone 70.

The gas control valves 60 and 62 are preferably zero governor or negative regulation type gas valves for providing fuel gas to the venturi 56 at a variable gas rate which is proportional to the negative air pressure within the venturi caused by the speed of the blower 52, hence varying the flow rate entering the venturi 56, in order to maintain a predetermined air to fuel ratio over the flow rate range within which the blower 52 operates. Each of the gas control valves 60 and 62 may be a double seated zero governor gas control valve including an integral shutoff valve.

It will be understood by those skilled in the art that gas valves such as the gas valves 60 and 62 operate in response to a sensed reference pressure in association with the pressure at low pressure zone 70 of venturi 56. Typically, such gas valves sense a reference pressure adjacent the inlet of the venturi such as schematically represented in FIG. 2 by the dashed pressure reference line 138 connecting the larger gas valve 62 to the venturi 56. In the present arrangement, however, it has been found to be preferred for the smaller gas valve 60 to take its reference pressure from a point upstream of the damper valve 58 as is represented by the dashed pressure reference line 140 connecting the smaller gas valve 60 to the damper valve 58.

The venturi 56 may be more generally described as a mixing chamber 56 upstream of the blower 52, the mixing chamber 56 being configured to at least partially pre-mix the fuel and air mixture prior to the fuel and air mixture entering the inlet 54 of blower 52. The venturi 56 may for example be constructed in accordance with the principles set forth in U.S. Pat. No. 5,971,026 to Beran, the details of which are incorporated herein by reference. Such venturi apparatus may be commercially obtained from Honeywell, Inc.

Figure 8:
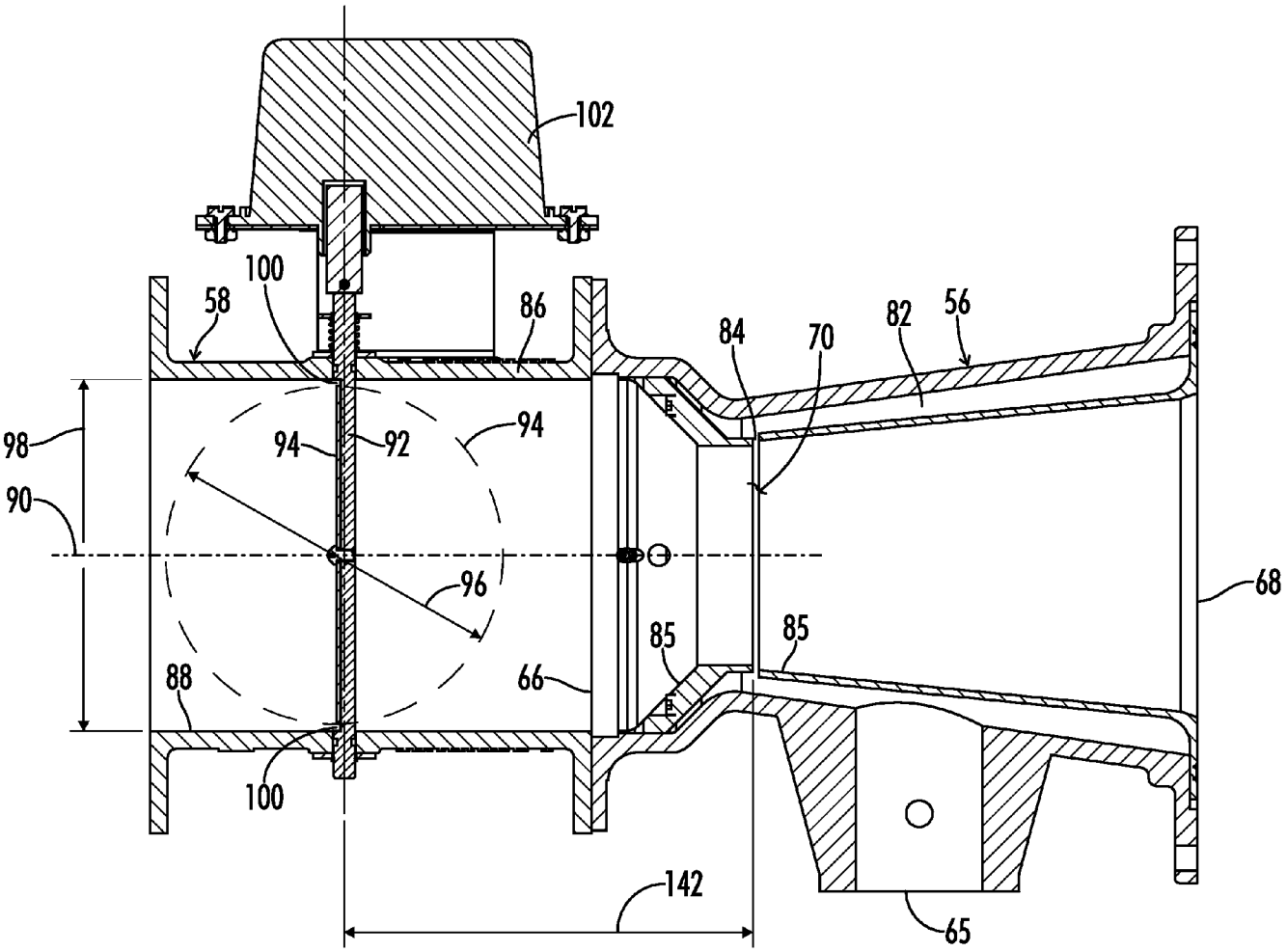
FIG. 8 is a cross-section elevation view of the motorized damper of FIG. 3 assembled with a venturi.

The details of construction of the venturi 56 are best seen in FIG. 8. There it is seen that the reduced pressure zone 70 is created adjacent the narrowest portion of the throat of the venturi, and that reduced pressure zone 70 is communicated with an outer annular area 82 through an annular opening 84.

The gas supply from gas valves 60 and 62 flows through the gas supply line 64 to the inlet 65 which is communicated with the annular zone 82.

Thus, as air flows through the venturi 56 from left to right as seen in FIG. 8, a low pressure zone 70 is created, which is communicated with the annulus 82, and which draws fuel gas through the operative one of the gas valves 60 and 62 in proportion to the negative pressure present within the annulus 82.

In an typical prior art system utilizing only a single gas valve with a venturi such as the venturi 56, the operating range of the venturi is related to the diameter of the venturi throat and proportional to the fluid volume that is drawn or pushed through the venturi. This operating range is limited on the lower end of its performance because the fluid volume and the velocity is insufficient to develop a flow field that creates the required negative pressure signal in annulus 82 to draw gas from the gas valve. That lack of a pneumatic pressure signal causes instability in the flow of gas from the gas valve through the venturi to the burner, which in turn creates instability in the combustion process.

The present invention seeks to eliminate those instabilities by adding the damper 58 upstream of the venturi, and by providing first and second smaller and larger gas valves 60 and 62 as shown.

As is further described below, the damper 58, which may be more generally referred to as an air flow restrictor 58, is movable between an open position and a restricted position, such that in the restricted position air flow through the damper 58 and the venturi 56 is restricted.

As is better shown in FIGS. 3-8, the damper valve 58 includes a valve body 86 having a circular cross-section passage 88 therethrough. The passage 88 has a longitudinal axis 90. A valve shaft 92 extends diametrically across the passage 88. A disc-shaped valve element 94 is attached to the shaft, and is shown in solid lines in its closed or restricted position, and in dashed lines in its open position in FIG. 8. The valve disc 94 has a diameter 96 which is less than an inner diameter 98 of the circular passage 88. The diameter 96 of the disc-shaped valve element 94 in some embodiments may have a diameter in a range of from about 3.0 inches to about 6.0 inches.

Figure 5:
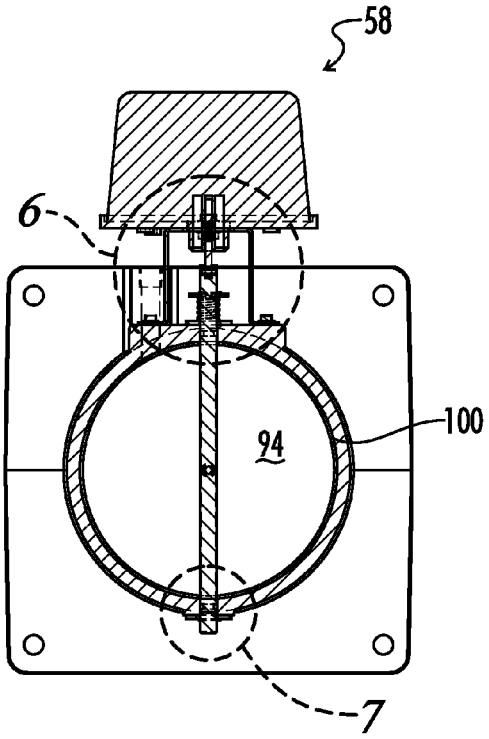
FIG. 5 is a cross-section elevation view of the motorized damper of FIG. 3, taken along line 5-5 of FIG. 4.

Thus, when the valve disc 94 is in its closed position shown in solid lines in FIG. 8 wherein it is generally concentrically received within the circular cross-section passage 88, an annular spacing 100 is present around the periphery of the valve disc 94, between the valve disc 94 and the inner wall of passage 88. As is further described in the examples below, that annular spacing may be in a range of from about 0.010 inch to about 0.150 inch, and more preferably in a range of from about 0.050 inch to about 0.120 inch. The annular clearance 100 is best seen in FIGS. 5-7.

The operation of the damper valve 58 is accomplished via a valve motor 102 attached to the valve shaft 92 and constructed to rotate the valve shaft 92 approximately 90° between the open position shown in dashed lines in FIG. 8, and the restricted or closed position shown in solid lines in FIG. 8.

The valve motor 102 may for example be a model GVD-4 available from Field Controls. The motor is programmed such that upon receiving a signal from the controller 200 to move from its open position to its restricted position or from its restricted position to its open position, the motor 102 rotates the valve stem 92 through an angle of 90°. The damper valve 58 and the valve motor 102 are constructed such that as the damper valve 58 repeatedly moves between its open and closed positions, the motor 102 turns the valve stem 92 constantly in one rotational direction. The valve motor 102 may be a synchronous motor using a mechanical switch to turn one quarter revolution at a speed for example of approximately 5 rpm.

Figure 6:
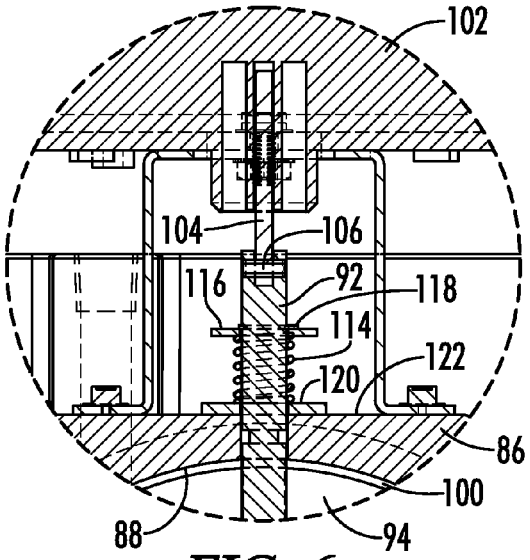
FIG. 6 is an enlarged view of the area within the upper dashed circled area of FIG. 5.
Figure 7:
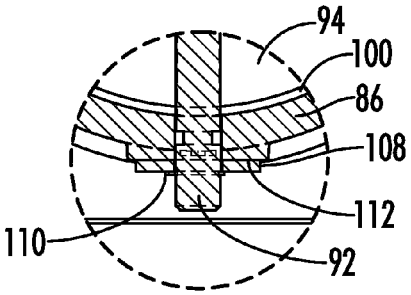
FIG. 7 is an enlarged view of the area within the lower dashed circled area of FIG. 5.

As best seen in FIG. 6, a drive shaft 104 of valve motor 102 is connected to valve shaft 92 by a pin 106.

It is preferred that the disc-shaped valve element 94 be held as concentrically as possible within the circular passage 88 so that the annular clearance 100 therebetween when the disc 94 is in its closed position will be as uniform as possible around the disc 94. This may be in part accomplished by constructing the mounting of the disc 94 within the valve body 86 as seen in the detailed views of FIGS. 6 and 7. The lower end of the valve shaft 92 has a washer 108 placed thereabout and held in place by a keeper ring 110 received in a groove in the shaft 92. The washer 108 engages a downward facing bearing surface 112 defined on the valve body 86.

As seen in FIG. 6, at the upper end of valve shaft 92 a coil compression spring 114 is disposed around the valve shaft 92 and its upper end engages a second washer 116 held in place relative to the valve shaft 92 by a second keeper ring 118 received in another groove in the valve shaft 92. The lower end of the spring 114 bears against yet another washer 120 which engages an upper surface 122 of valve body 86, such that the spring 114 biases the valve shaft 92 and the attached valve disc 94 relative to the valve body 86 so as to eliminate slack in the diametrical positioning of the valve disc 94 within the circular cross-section passage 88 of valve body 86.

Figure 12:
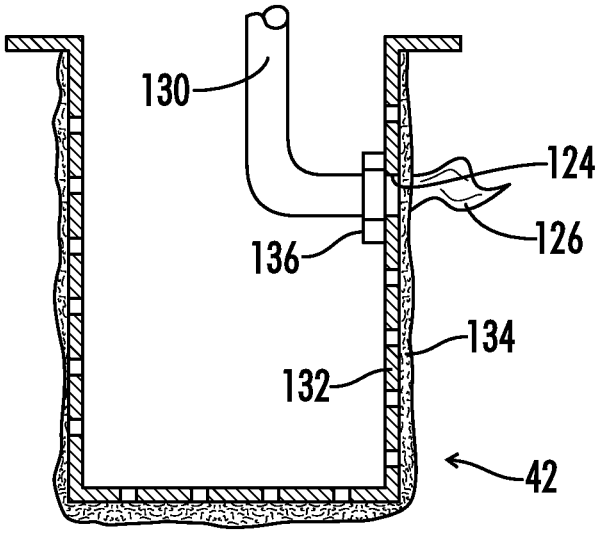
FIG. 12 is a schematic cross-section view of the burner having a pilot supply line located internal of the burner and communicated with a pilot port defined in a sidewall of the burner.

Referring now to FIG. 12, the burner assembly 10 may include a pilot 124 located adjacent the burner 42 such that a pilot flame 126 from the pilot can ignite the burner 42. The pilot is provided in order to avoid problems which are otherwise encountered when transitioning between the operation of the small gas valve 60 and the large gas valve 62 or vice versa. Those problems typically involve the loss of burner flame, and high carbon monoxide levels in the heater exhaust.

As shown in FIG. 2, a pilot valve 128 is connected to the gas inlet line 78 and communicates the gas source 76 with the pilot 124 via pilot gas line 130. As is further described below, the controller 200 is configured to open the pilot valve 128 so as to initiate the pilot flame 126 of pilot 124 prior to transitioning between the operation of the smaller and larger gas valves 60 and 62. The pilot valve 128 may be a solenoid valve and regulator combination valve.

As is schematically illustrated in FIG. 12, the burner 42 may include a rigid internal burner can 132 made of perforated metal or the like, surrounded by a metal or ceramic fiber outer layer 134. The pilot 124 is preferably defined as a circular opening through the side wall of the inner can 132, and the pilot gas line 130 is connected to the pilot opening 124 by a fitting 136 attached to the inner can 132 by any appropriate means such as welding, riveting or the like.

The pilot 124 which may be referred to as an integrated pilot burner port 124 establishes the pilot flame 126 on the face of the burner 42. Additionally, by having the pilot gas supply line 130 internal to the main burner can, with the pilot port 124 extending through the side wall of the main burner can, the pilot structure is not exposed to the temperatures of the main flame exterior of the burner can. This eliminates the need to use special high temperature components for the pilot assembly.

Optionally, a separate pilot assembly separate from the burner 42 may be mounted closely adjacent to the exterior of the burner 42.

Other optional approaches instead of using the pilot 124 include the repetitive use of the spark igniter 228 along with repetition of the pre-purge cycle each time the system is transitioned between operation in the high output range and low output range, or the use of a hot surface igniter which is always operable to ignite gas coming from either the small gas valve 60 or large gas valve 62.

Figure 11:
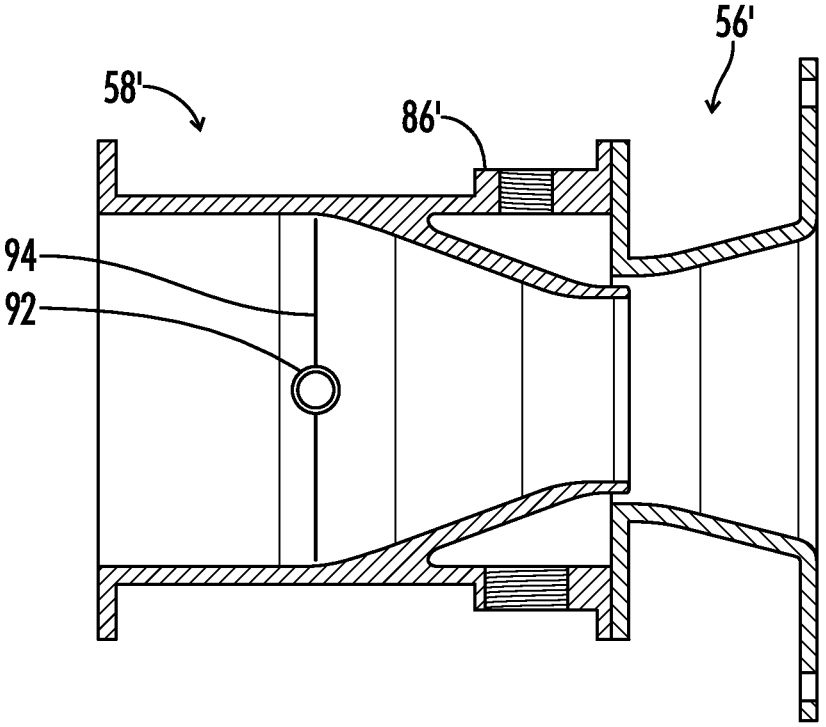
FIG. 11 is a schematic cross-section view of an alternative embodiment of the venturi and damper assembly, having an integral venturi/damper body.

Alternative Venturi and Damper Arrangement of FIG. 11

Referring now to FIG. 11, an alternative construction for the venturi 56 and damper valve 58 shown in FIG. 8 is shown. In the embodiment of FIG. 11, a venturi 56' and a damper valve 58' are shown utilizing a common integral venturi/damper body 86'. Otherwise, the manner of operation and the function of the various components illustrated in the embodiment of FIG. 11 are analogous to those of the embodiments described above for FIGS. 1-8.

Methods of Operation

The following steps represent a typical sequence of operation for the burner assembly 10 of the heater apparatus 11 beginning with startup, then operating through a range of heater outputs extending from the lowest output to the highest output, then reducing the heater output back to the lowest output and shutting down the heater. The following 20 steps summarize that procedure, and each step is further described below:

SEQUENCE OF OPERATION

1. Purge (Blower RPMs Max Setting)
2. Close Shutter (Adjust RPMs to ignition values)
3. Turn on Spark Igniter
4. Turn on Stage 1 gas valve
5. Prove Main Burner Flame
6. Turn off Spark Igniter
7. Operation in Stage 1 (RPMs adjusted per modulation rate)
8. Turn on Transition Solenoid Valve (Adjust RPMs to transition setting)
9. Turn off Stage 1 gas valve & Prove Transition Flame
10. Open Shutter
11. Turn on Stage 2 gas valve
12. Turn off Transition Solenoid Valve & Prove Main Burner Flame
13. Operate in Stage 2 up to Full Fire & transition back down (Adjust RPMs per modulation rate)
14. Turn on transition Solenoid Valve (Adjust RPMs to transition setting)
15. Turn off Stage 2 gas valve & Prove Transition Flame
16. Close Shutter
17. Turn on Stage 1 gas valve
18. Turn off Transition Solenoid Valve & Prove Main Burner Flame
19. Operate in Stage 1 down to low fire then turn off (Adjust RPMs per modulation rate)
20. Post Purge In step 1, the system is purged by operating the blower 52 at maximum blower speed to purge the system.

In step 2, the damper valve 58 is closed and the rotational speed of the blower 52 is reduced to a relatively low speed for ignition.

In step 3, the controller 200 sends an ignition signal to igniter 228.

In step 4, the controller 200 sends a control signal to the small gas valve 60 to turn the small gas valve 60 on, which should result in ignition of the main burner 42.

In step 5, the presence of the main burner flame is proven via an input signal to the controller 200 from the main flame sensor 204.

In step 6, the spark igniter 228 is turned off via a signal from the controller 200.

In step 7, the burner assembly 10 is operated in what may be referred to as Stage 1, or in a low output range, by modulating the speed of the variable speed blower 52 while drawing air through venturi 56 and damper valve 58 with the damper valve 58 in its closed or restricted position. This operation continues throughout the low output range of the burner assembly 10 until the blower 52 reaches its maximum blower speed.

Then, in step 8, in order to transition from the low output range to a high output range associated with an open position of damper 58 and with operation of the larger gas valve 62, the controller 200 opens the pilot valve 128 so as to light the pilot flame 126, and the blower speed of blower 52 is reduced to a transition setting.

Then, in step 9, the smaller gas valve 60 is closed in response to a signal from controller 200, and the existence of the transition or pilot flame 126 is proven via signal from the pilot flame sensor 202 to the controller 200.

Then, in step 10, the damper 58 is moved to its open position.

In step 11, the large gas valve 62 is opened in response to a control signal from controller 200.

In step 12, the pilot valve 128 is closed and main burner flame is proven via input signal from main burner flame sensor 204 to the controller 200.

Step 13 represents the operation of the burner apparatus 10 in what may be referred to as Stage 2 or in a high output range wherein the damper valve 58 is open and the large gas supply valve 62 is operable. The burner apparatus 10 operates throughout this high output range by increasing the blower speed of blower 52 up to its maximum output which may be referred to as a full fire operation of the burner apparatus 10. Then to reduce the output of the burner apparatus 10, the speed of blower 52 is again reduced back down through the high output range.

In step 14, preparatory to transitioning from the high output range back to the low output range, the pilot valve 128 is again opened.

In step 15, the large gas valve 62 is closed and the presence of the transition or pilot flame 126 is again proven via pilot flame sensor 202.

Then in step 16, the damper 58 is moved to its closed or restricted position in response to a control signal from controller 200.

In step 17, the controller 200 again turns on the small gas valve 60.

In step 18, the pilot valve 128 is again closed and main burner flame in the low operating range is again proven via signal from the main burner flame sensor 204 to controller 200.

Step 19 represents the operation of the burner apparatus 10 again in Stage 1 or the low output range until it is desired to turn off the burner apparatus 10.

Step 20 represents the post-purging operation wherein the blower 52 is utilized to clear the system with both gas supply valves 60 and 62 and the pilot valve 128 all closed.

Figure 9:
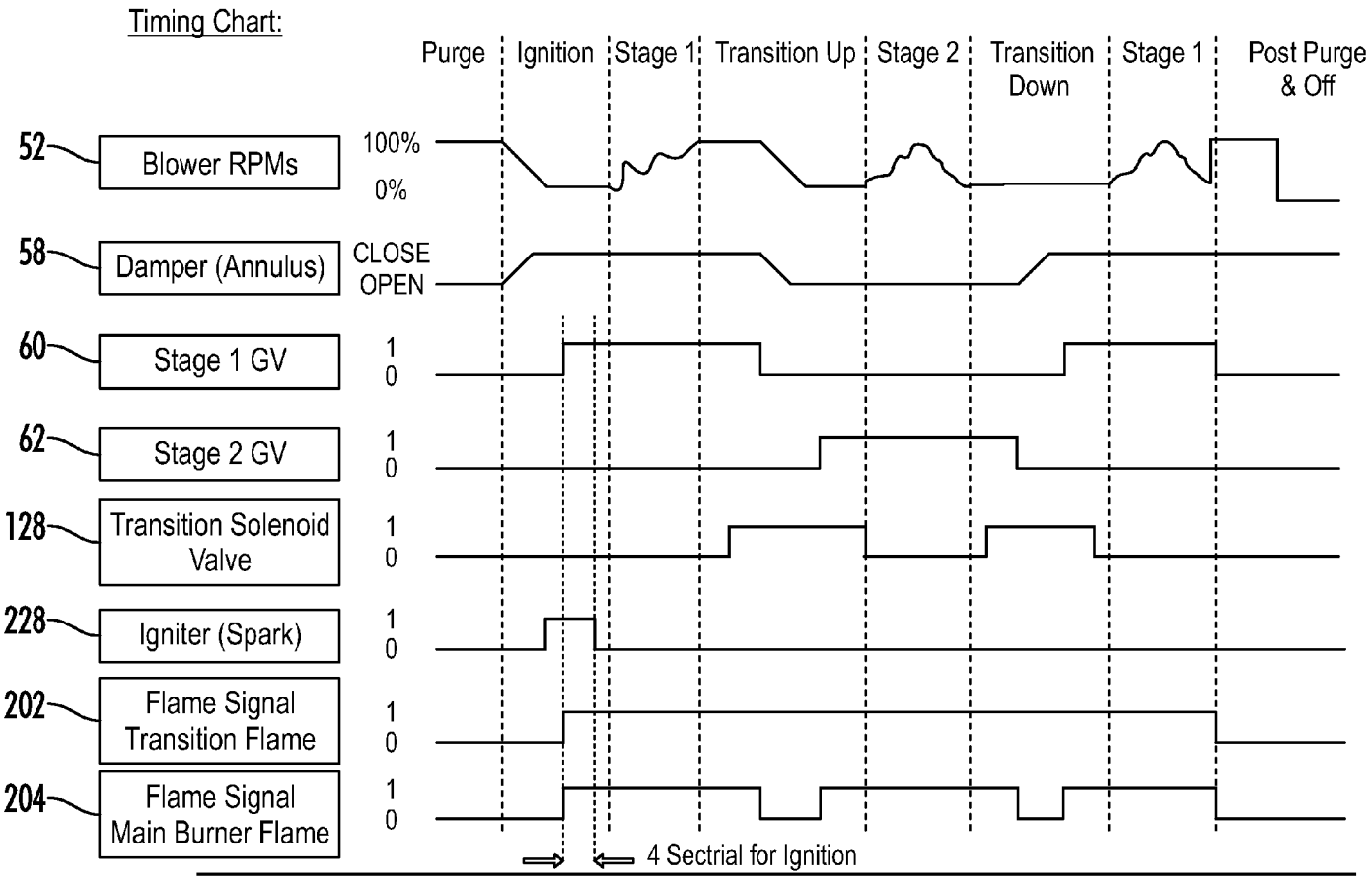
FIG. 9 is a graphic timing chart showing the operational positions of the various components of the burner assembly of FIG. 2 as the burner assembly starts up and cycles through an increasing and a decreasing load cycle.

FIG. 9 is a schematic timing chart representative of the position of the various indicated components throughout the sequence of operation represented by steps 1-20 described above.

In general, the method of operating the burner apparatus 10 may be described as a method of operating a pre-mix burner, the method comprising:

(a) modulating the burner 42 within a low output range by modulating a speed of the variable speed blower 52 while drawing air to the venturi 56 through the damper valve 58 while the damper valve 58 is in its restricted position, and while drawing fuel gas to the venturi 56 through the smaller gas valve 60; and (b) modulating the burner 42 within a high output range by modulating the speed of the variable speed blower 52 while drawing air to the venturi 56 through the damper valve 58 with the damper valve in its open position, and while drawing fuel gas to the venturi 56 through the larger gas valve 62.

In step (a) the air flows through the venturi 56 through the annular passage 100 of the damper valve 58 adjacent to an inner wall 85 of the venturi 56 so that the air flows primarily in a boundary layer adjacent the inner wall 85. It will be appreciated by those skilled in the art that the venturi 56 operates in a manner such that the pressure in the low pressure zone 82 is dependent upon that pressure seen at the annular opening 84 which is of course the pressure at the boundary layer of the surface 85 as that boundary layer passes across the annular opening 84. Thus, the damper 58 is designed to influence the pressure in that boundary layer adjacent the annular opening 84.

The method of operation may also be described as including a step of controlling a transition from the low output range to the high output range with the automatic controller 200 by modulating the blower speed of blower 52, activating the larger gas valve 62, deactivating the smaller gas valve 60, and opening the damper valve 58.

The methods of operation may further be described as including a step of opening the pilot valve 128 to light the pilot 124 adjacent the burner 42 before transitioning from the low output range to the high output range.

The methods of operation may be described as further including a step of controlling a transition from the high output range to the low output range with the automatic controller 200 by modulating the blower speed of blower 52, activating the smaller gas valve 60, deactivating the larger gas valve 62, and moving the damper valve 58 to its restricted position.

The methods of operation may be further described as including a step of opening the pilot valve 128 to light the pilot 124 adjacent the burner 42 before transitioning from the high output range to the low output range.

The blower 52 may be described as a variable speed blower 52 having a blower speed variable within a blower speed range. For example the blower speed of blower 52 may be modulated from a low speed of 1200 rpm to a high speed of 5,000 rpm. The controller 200 is operably associated with the blower 52 and configured such that the burner 42 is modulatable within a higher burner output range by varying the blower speed within the blower speed range when the larger gas valve 62 is operable and the damper valve 58 is in the open position, and such that the burner 42 is modulatable within a lower burner output range by varying the blower speed within the blower speed range when the smaller gas valve 60 is operable and the flow restrictor or damper valve 58 is in the restricted position.

It is preferable that the higher burner output range overlap at its lower end with the higher end of the lower burner output range. This output range overlap is preferably at least 50,000 BTU/hr.

In one embodiment, the high output range may have a turndown ratio of approximately 5:1, and the low output range may provide a further turndown ratio of approximately 5:1, thus resulting in an overall turndown ratio from a high end of the higher burner output range to a low end of the lower burner output range of at least 25:1.

The burner apparatus 10 may have a burner output at the high end of the higher output range of at least 750,000 BTU/hr. In other embodiments the high end of the higher burner output range may be at least 2 million BTU/hr or higher.

The controller 200 may be described as defining a low range operation mode of the burner assembly 10 and a high range operation mode of the burner assembly 10. In the low range operation mode the controller places the damper valve 58 in the restricted position, the smaller gas valve 60 is operably communicated with the venturi 56, and the blower 52 is modulated to provide fuel and air mixture to the burner within the low output range.

In the high range operation mode the controller 200 places the damper valve 58 in the open position, the larger gas valve 62 is operably communicated with the venturi 56, and the blower 52 is modulated to provide fuel and air mixture to the burner 42 within the high output range.

Exemplary Apparatus

In one example of the damper valve 58 and the venturi 56 designed for a maximum boiler output at the upper end of the high output range of 750,000 BTU/hr, the valve disc 94 may have a diameter 96 of 3.810 inches, and the valve disc 94 may be axially spaced from the low pressure zone 70 by a distance 142 as indicated in FIG. 8 of 6.189 inches. The gap 100 may have a dimension of 0.083 inches. The venturi 56 may be a model VMU300A venturi available from Honeywell, Inc.

In another example of the damper valve 58 and the venturi 56 designed for a maximum boiler output at the upper end of the high output range of 1,250,000 BTU/hr, the valve disc 94 may have a diameter 96 of 4.850 inches, and the valve disc 94 may be axially spaced from the low pressure zone 70 by a distance 142 as indicated in FIG. 8 of 6.189 inches. The gap 100 may have a dimension of 0.063 inches. The venturi 56 may be a model VMU500A venturi available from Honeywell, Inc.

In another example of the damper valve 58 and the venturi 56 designed for a maximum boiler output at the upper end of the high output range of 2 million BTU/hr, the valve disc 94 may have a diameter 96 of 4.750 inches, and the valve disc 94 may be axially spaced from the low pressure zone 70 by a distance 142 as indicated in FIG. 8 of 5.787 inches. The gap 100 has a dimension of 0.113 inches. The venturi 56 may be a model VMU680A venturi available from Honeywell, Inc.

The selection of the clearance of annular space 100, and the distance 142 between the valve 94 and the throat or low pressure zone 72 of venturi 56 are important to proper functioning of the apparatus. The selection of distance 142 is made within the available spacing to ensure the creation of a stable boundary layer type flow at the low pressure zone 70. Typical ratios of distance 142 to diameter 96 may for example be from 1.0 to 2.0.

It will be understood that the size of the blower 52 and other associated components will be selected to complement the needs of the burner apparatus 10 for the selected burner output using the selected damper valve 48 and venturi 56 described in the examples described above.

Also, in order to insure adequate flow velocities of the fuel and air mixture through the burner 42 at the lower end of the low burner output range, while providing a turndown ratio of at least 25:1, it is preferable to provide a relatively high burner loading for burner 42. Whereas a typical prior art pre-mix burner may have a burner loading in the range of 600,000 to 700,000 BTU/hr·ft$^2$, the burner 42 may be designed with a burner loading of greater than 1 million BTU/hr·ft$^2$ and even more preferably as much as 1.2 million BTU/hr·ft$^2$.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are embodied with the scope and spirit of the present invention as defined by the following claims.

What is claimed is:

1. A burner assembly, comprising:

a burner;

a blower configured to supply pre-mixed air and fuel gas mixture to the burner, the blower including a blower inlet;

a venturi including a venturi inlet, a venturi outlet, and a reduced pressure zone intermediate of the venturi inlet and the venturi outlet, the blower inlet being communicated with the venturi outlet such that the blower pulls air through the venturi;

at least one gas valve communicated with the reduced pressure zone such that the at least one gas valve supplies fuel gas to the reduced pressure zone at a fuel gas flow rate corresponding to a pressure in the reduced pressure zone; and an air flow restrictor located upstream of the reduced pressure zone and movable between an open position and a restricted position, such that in the restricted position air flow through the venturi inlet is still permitted but is restricted by the air flow restrictor, wherein the air flow restrictor comprises a disc-shaped valve element, the restrictor defining an annular flow path around the disc-shaped valve element when the air flow restrictor is in the restricted position.

2. The burner assembly of claim 1, wherein:

the annular flow path has an annular thickness in a range of from 0.010 inch to 0.150 inch.

3. The burner assembly of claim 1, wherein:

the at least one gas valve includes a larger gas valve and a smaller gas valve, both gas valves being communicated with the reduced pressure zone of the venturi.

4. The burner assembly of claim 3, wherein:

the smaller gas valve includes a reference pressure line communicated upstream of the air flow restrictor.

5. The burner assembly of claim 3, further comprising:

a controller operably associated with the flow restrictor, the larger gas valve and the smaller gas valve, the controller being configured to operate the larger gas valve when the flow restrictor is in the open position, and the controller being configured to operate the smaller gas valve when the flow restrictor is in the restricted position.

6. The burner assembly of claim 5, wherein:

the blower is a variable speed blower having a blower speed variable within a blower speed range; and the controller is operably associated with the blower and configured such that the burner is modulatable within a higher burner output range by varying the blower speed within the blower speed range when the larger gas valve is operable and the flow restrictor is in the open position, and such that the burner is modulatable within a lower burner output range by varying the blower speed within the blower speed range when the smaller gas valve is operable and the flow restrictor is in the restricted position.

7. The burner assembly of claim 6, wherein the higher burner output range overlaps the lower burner output range.

8. The burner assembly of claim 6, wherein the burner assembly has a turndown ratio from a high end of the higher burner output range to a low end of the lower burner output range of at least 25 to 1.

9. The burner assembly of claim 6, wherein the burner higher output range has a high end of at least 750,000 BTU/hr.

10. The burner assembly of claim 5, further comprising:

a pilot located adjacent the burner such that a pilot flame from the pilot can ignite the burner;

a pilot valve communicating a gas source with the pilot; and wherein the controller is configured to open the pilot valve so as to initiate the pilot flame prior to transitioning between operation of the smaller gas valve and operation of the larger gas valve.

11. The burner assembly of claim 10, wherein:

the controller is configured to close the pilot valve after transitioning between operation of the smaller gas valve and operation of the larger gas valve.

12. The burner assembly of claim 1, wherein:

the venturi includes a venturi body, including a venturi passage from the venturi inlet to the venturi outlet; and the flow restrictor is located within the venturi passage.

13. The burner assembly of claim 1, wherein:

the venturi includes a reduced diameter throat, and the reduced pressure zone includes an annular zone surrounding and communicated with the reduced diameter throat.

14. The burner assembly of claim 1, in combination with a water heater, the water heater being in heat exchange relationship with the burner.

* * * * *